US012735795B2

(12) United States Patent
Lee et al.

(10) Patent No.: US 12,735,795 B2
(45) Date of Patent: Sep. 15, 2026

(54) CATALYST FOR ELECTROLYSIS AND PREPARING METHOD OF THE SAME

(71) Applicants: RESEARCH & BUSINESS FOUNDATION SUNGKYUNKWAN UNIVERSITY, Suwon-si (KR); INSTITUTE FOR BASIC SCIENCE, Daejeon (KR)

(72) Inventors: Hyoyoung Lee, Uiwang-si (KR); Xinghui Liu, Suwon-si (KR)

(73) Assignees: RESEARCH & BUSINESS FOUNDATION SUNGKYUNKWAN UNIVERSITY, Suwon-si (KR); INSTITUTE FOR BASIC SCIENCE, Daejeon (KR)

( * ) Notice: Subject to any disclaimer, the term of this patent is extended or adjusted under 35 U.S.C. 154(b) by 639 days.

(21) Appl. No.: 18/110,050

(22) Filed: Feb. 15, 2023

(65) Prior Publication Data

US 2023/0257892 A1 Aug. 17, 2023

(30) Foreign Application Priority Data

Feb. 15, 2022 (KR) ..... 10-2022-0019456

(51) Int. Cl.
*C25B 11/093* (2021.01)
*C25B 1/04* (2021.01)

(52) U.S. Cl.
CPC ..... *C25B 11/093* (2021.01); *C25B 1/04* (2013.01)

(58) Field of Classification Search
CPC ..... B01J 21/18; B01J 23/468; B01J 23/625; B01J 35/58; B01J 37/08; B01J 37/16; B01J 23/40; B01J 23/46; B01J 23/52; B01J 23/6486; B01J 23/652; B01J 23/6522; B01J 23/6527; B01J 23/6562; B01J 23/64; B01J 23/648
See application file for complete search history.

(56) References Cited

U.S. PATENT DOCUMENTS 4,158,643 A * 6/1979 Sinha ..... B01J 21/18 423/247
9,040,210 B2 * 5/2015 Kremliakova ..... H01M 4/8825 429/524
10,431,831 B2 * 10/2019 Sakai ..... B01J 23/626
2004/0220052 A1 * 11/2004 He ..... C01B 3/16 502/313
2010/0323272 A1 * 12/2010 Ozaki ..... H01G 11/42 423/384

(Continued)

FOREIGN PATENT DOCUMENTS

JP 2020-156219 A 9/2020
KR 20090041135 A * 4/2009 ..... D01F 9/12
WO WO-2006012548 A2 * 2/2006 ..... D01D 5/0038

OTHER PUBLICATIONS

English language machine translation of KR 20090041135 (Apr. 28, 2009).*

(Continued)

*Primary Examiner* — Christina A Johnson
(74) *Attorney, Agent, or Firm* — LEX IP MEISTER, PLLC

(57) ABSTRACT

The present disclosure relates to an electrolysis catalyst including a graphitic carbon layer; and a first metal and a second metal oxide dispersed in the graphitic carbon layer, wherein the first metal is electron-deficient.

11 Claims, 22 Drawing Sheets

(56) References Cited

U.S. PATENT DOCUMENTS

| | | | | |
|---|---|---|---|---|
| 2011/0151354 | A1* | 6/2011 | Jin | H01M 4/926 977/734 |
| 2011/0171565 | A1* | 7/2011 | Birkan | D01D 5/0038 977/762 |
| 2015/0056471 | A1* | 2/2015 | Joo | C04B 35/63488 501/153 |
| 2018/0006313 | A1* | 1/2018 | Haas | H01M 4/8803 |
| 2019/0376209 | A1* | 12/2019 | Kisailus | D01D 10/02 |
| 2021/0060533 | A1* | 3/2021 | Whang | H01M 4/9083 |
| 2023/0271166 | A1* | 8/2023 | Hwang | B01J 37/348 |

OTHER PUBLICATIONS

Liu, Xinghui, et al. "Restructuring highly electron-deficient metal-metal oxides for boosting stability in acidic oxygen evolution reaction." *Nature Communications* vol. 12. Issue 1 (2021): 5676. pp 1-11.

Tariq, Muhammad, et al. "Unraveling the beneficial electrochemistry of IrO2/MoO3 hybrid as a highly stable and efficient oxygen evolution reaction catalyst." *ACS Sustainable Chemistry & Engineering* vol. 6. Issue 4 (2018). pp 1-10.

* cited by examiner

【Fig. 1】
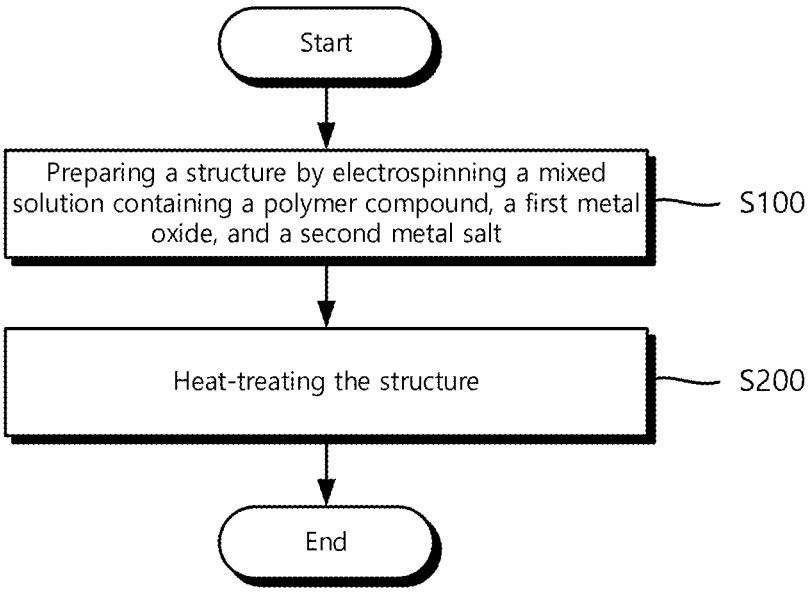

【Fig. 2(A)】
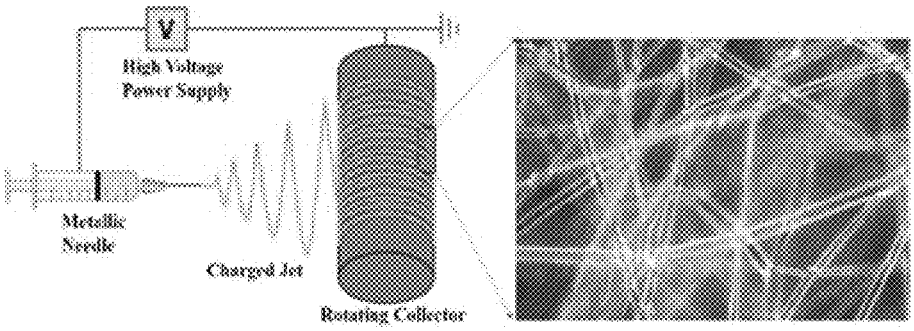

【Fig. 2(B)】
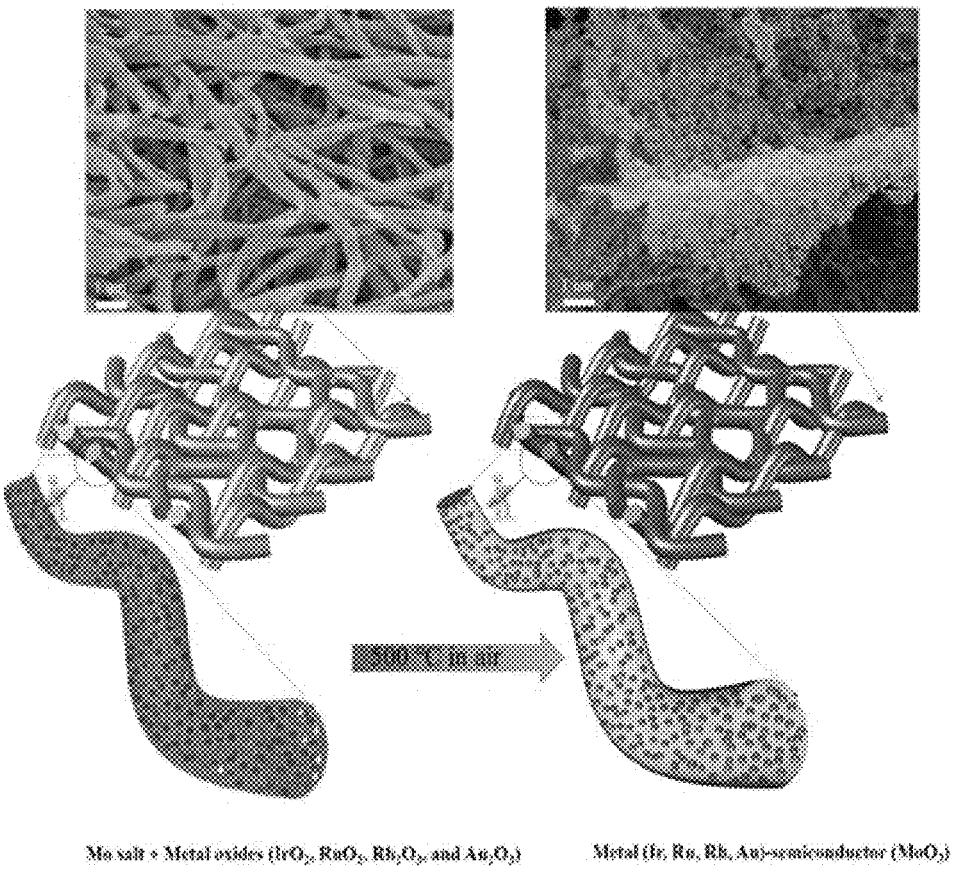

【Fig. 3(A)】
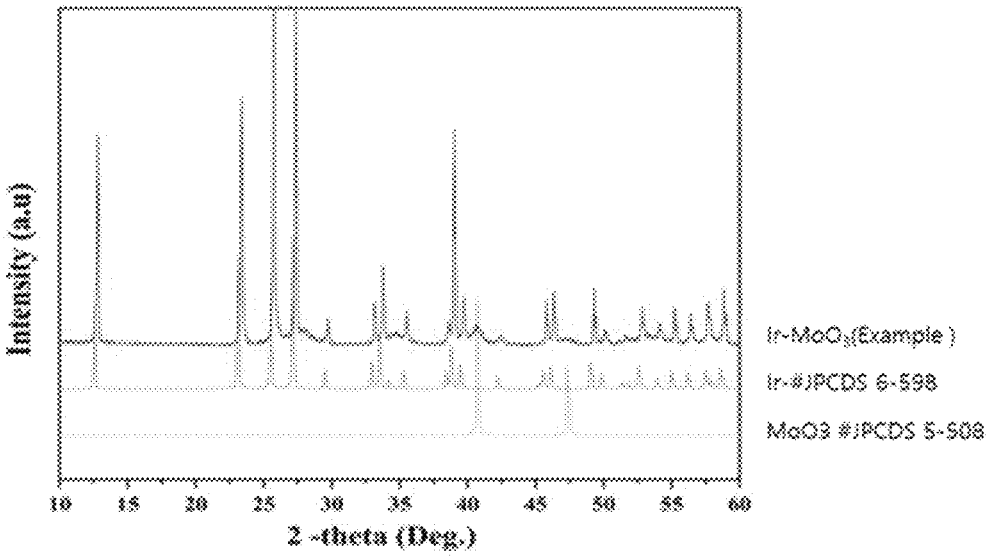
【Fig. 3(B)】
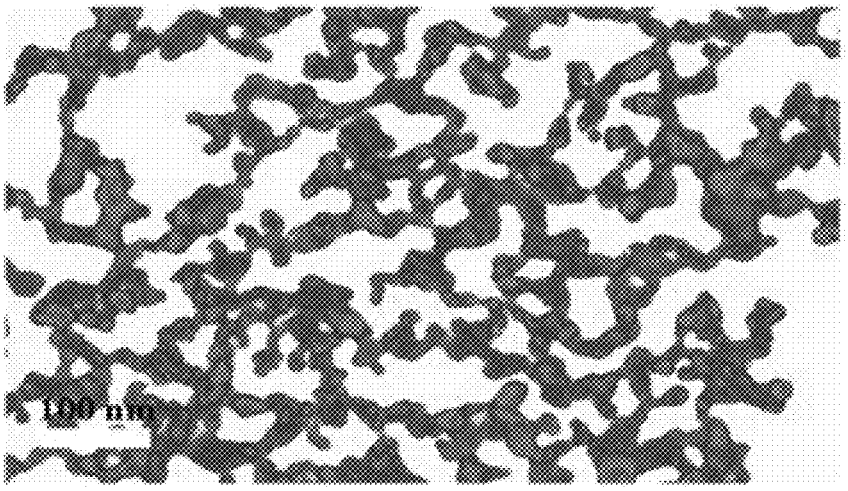

【Fig. 4(A)】
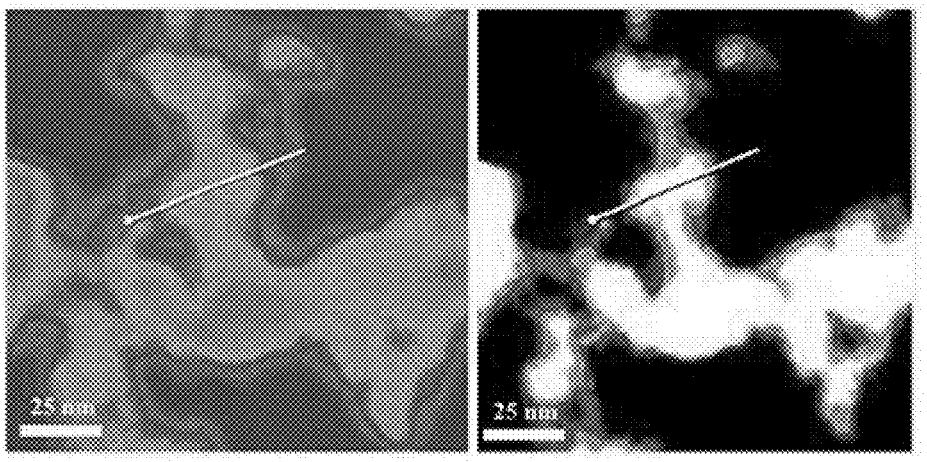
【Fig. 4(B)】
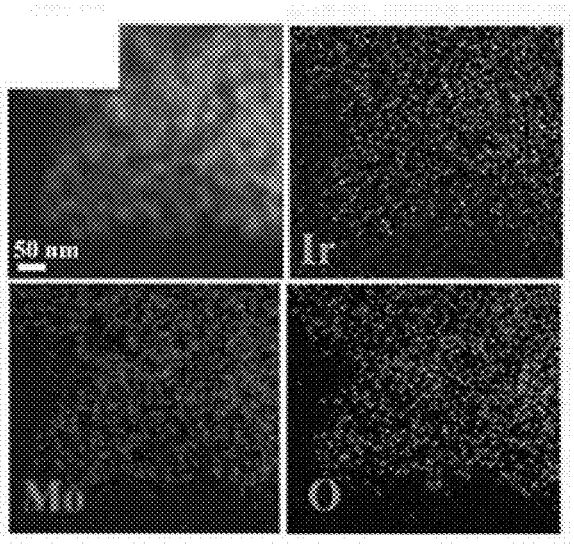

【Fig. 5(A)】
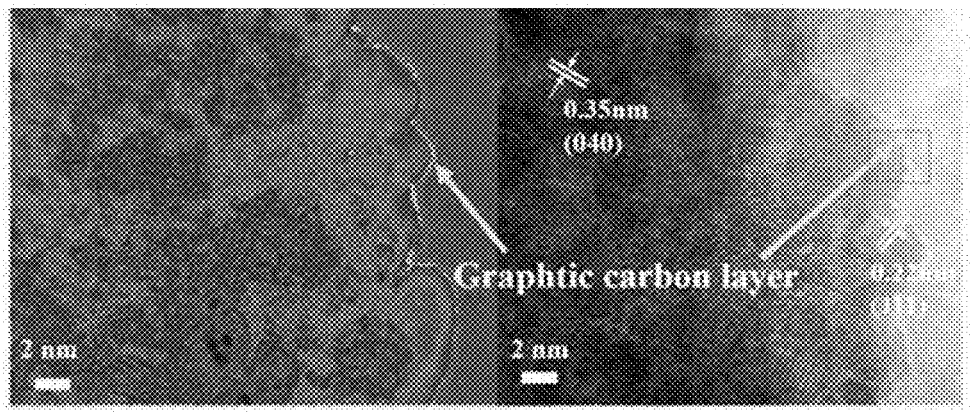
【Fig. 5(B)】
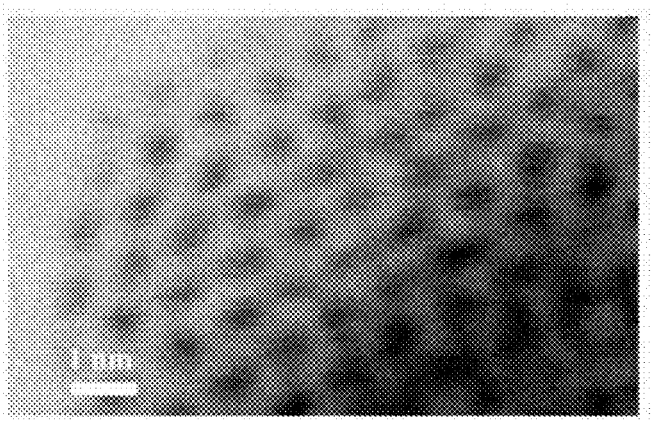

【Fig. 6(A)】
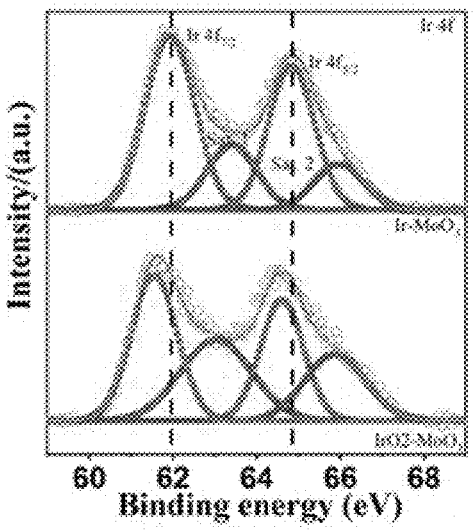
【Fig. 6(B)】
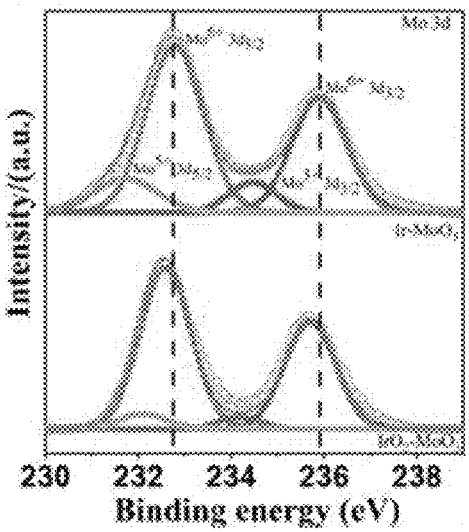

【Fig. 6(C)-(D)】
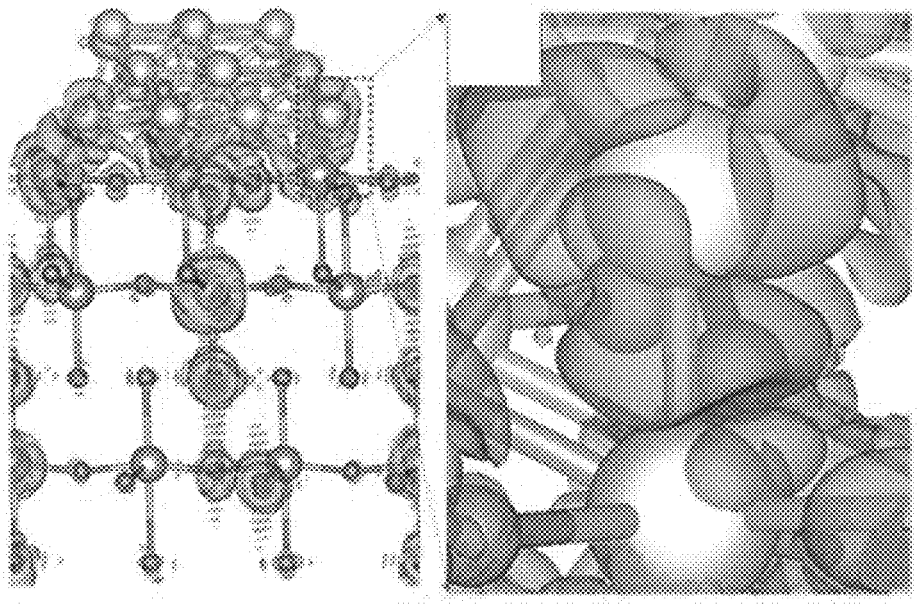
【Fig. 6(C)】 【Fig. 6(D)】

【Fig. 7(A)】
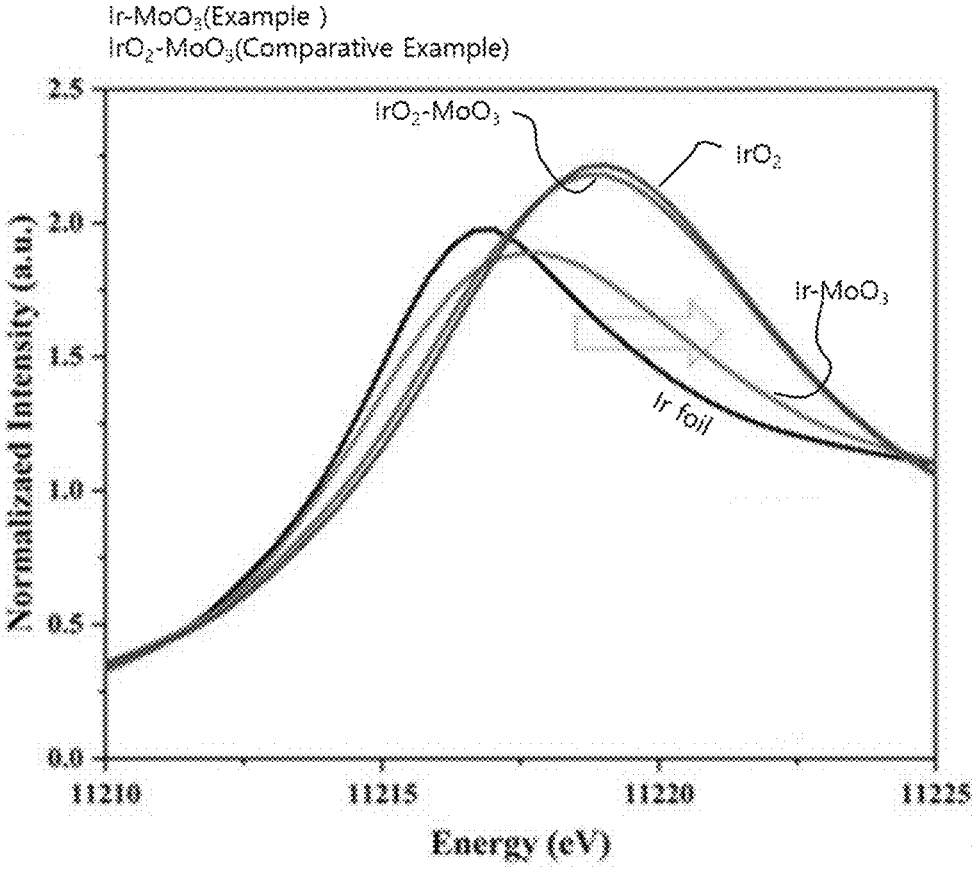

【Fig. 7(B)】
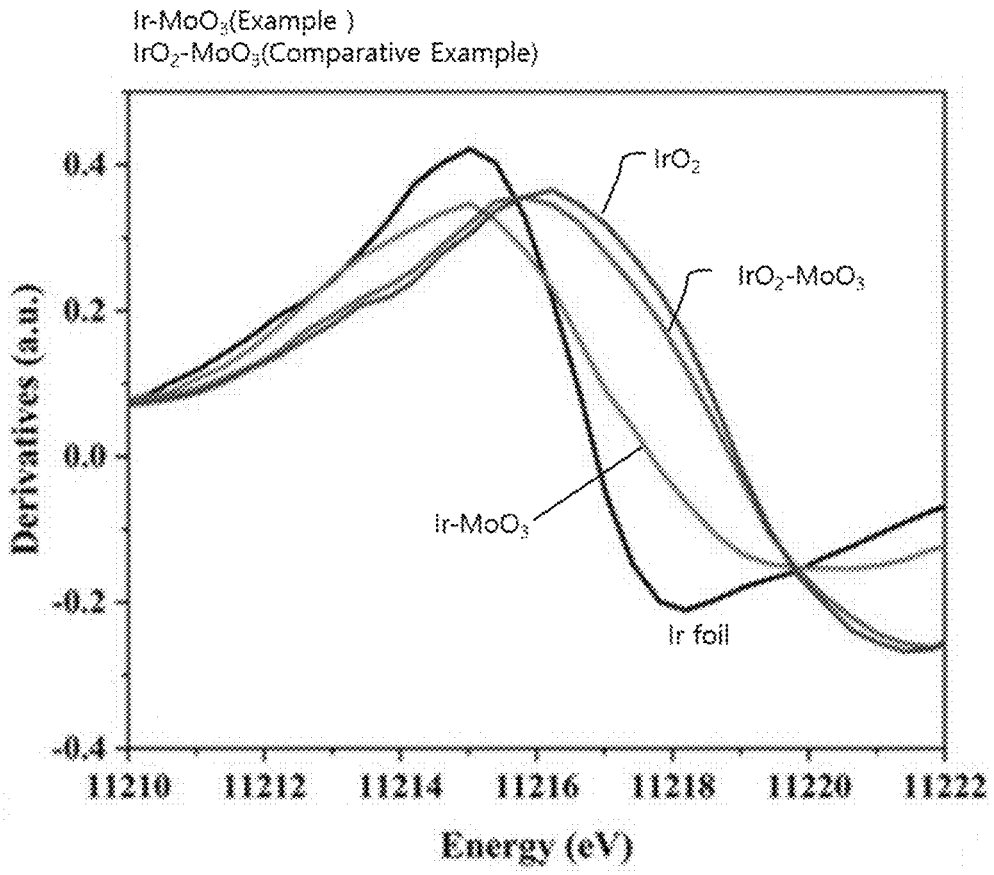

【Fig. 7(C)】
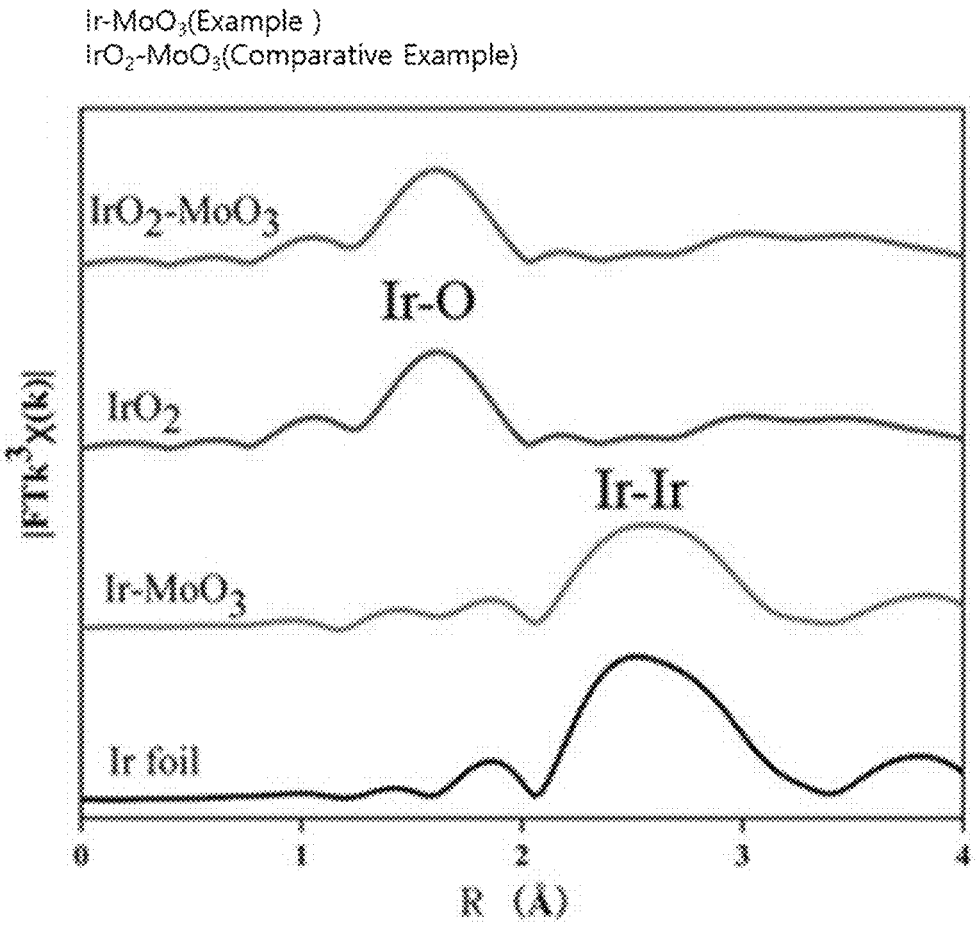

【Fig. 7(D)】
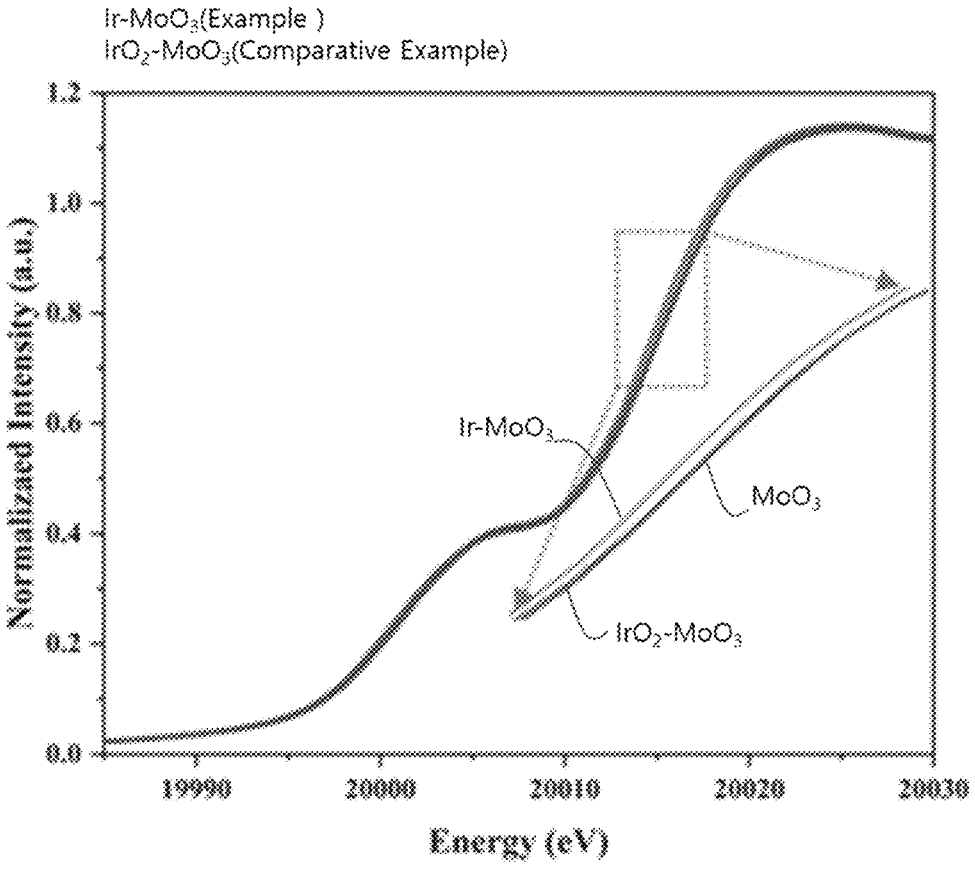

【Fig. 7(E)】
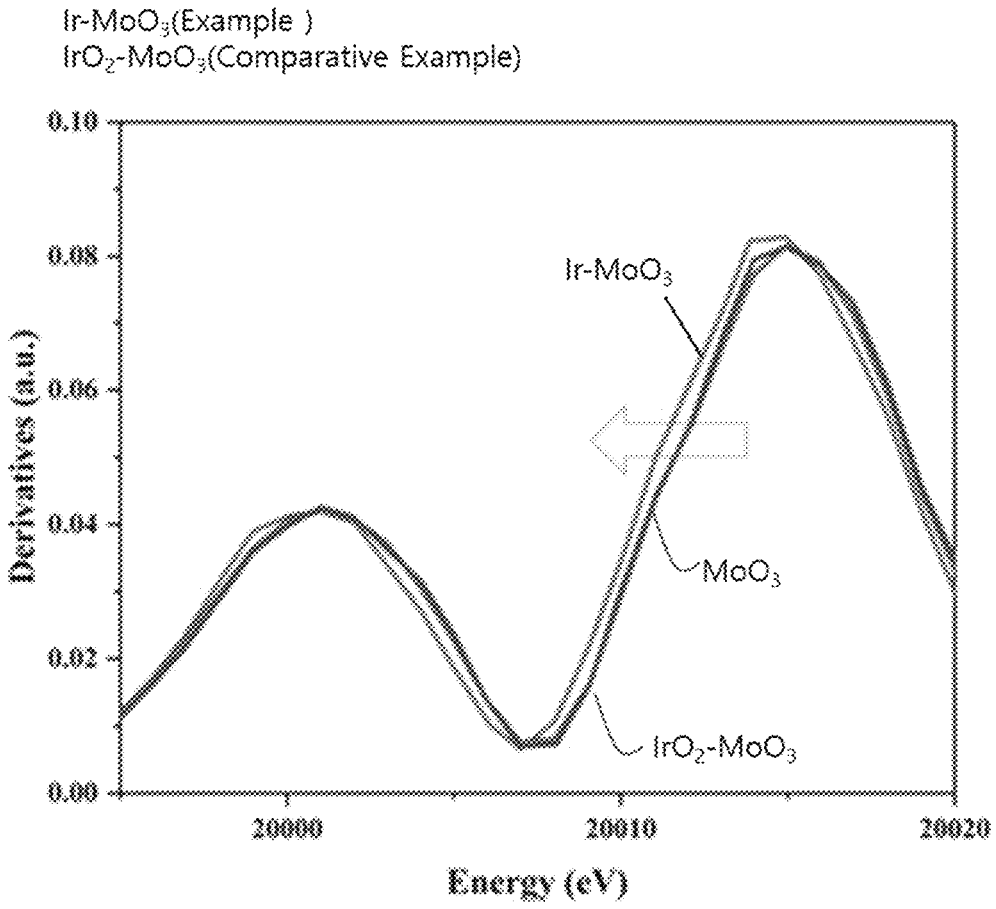

【Fig. 7(F)】
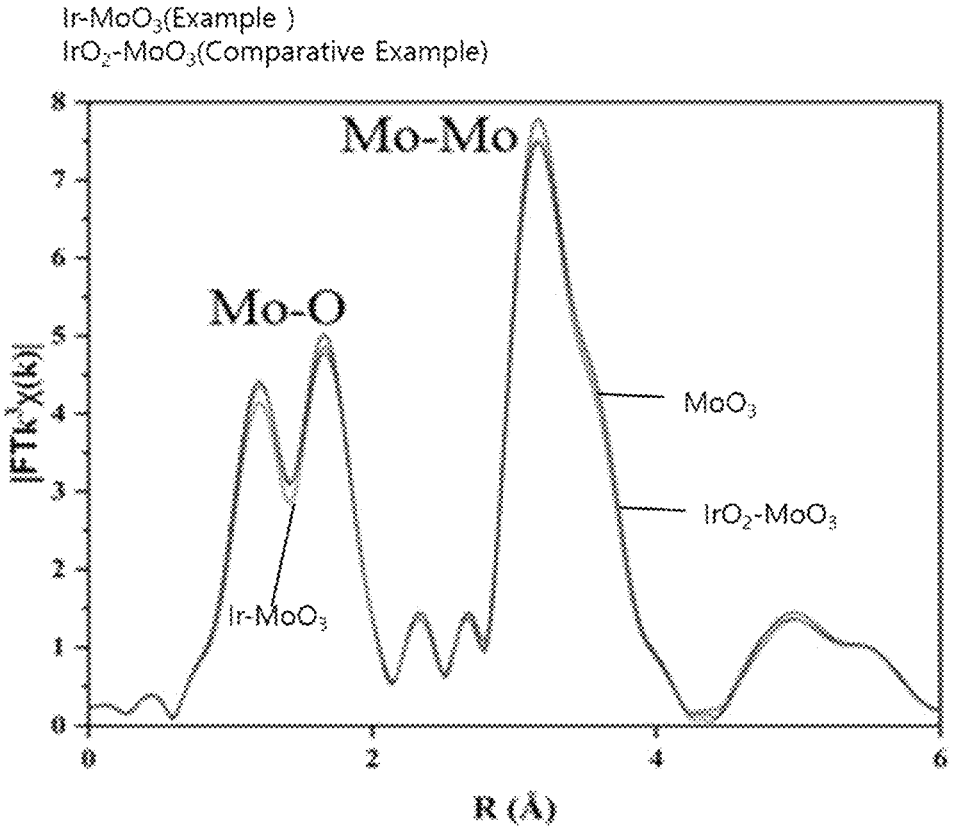

【Fig. 8】
Ir-$MoO_3$(Example )
$IrO_2$-$MoO_3$(Comparative Example)
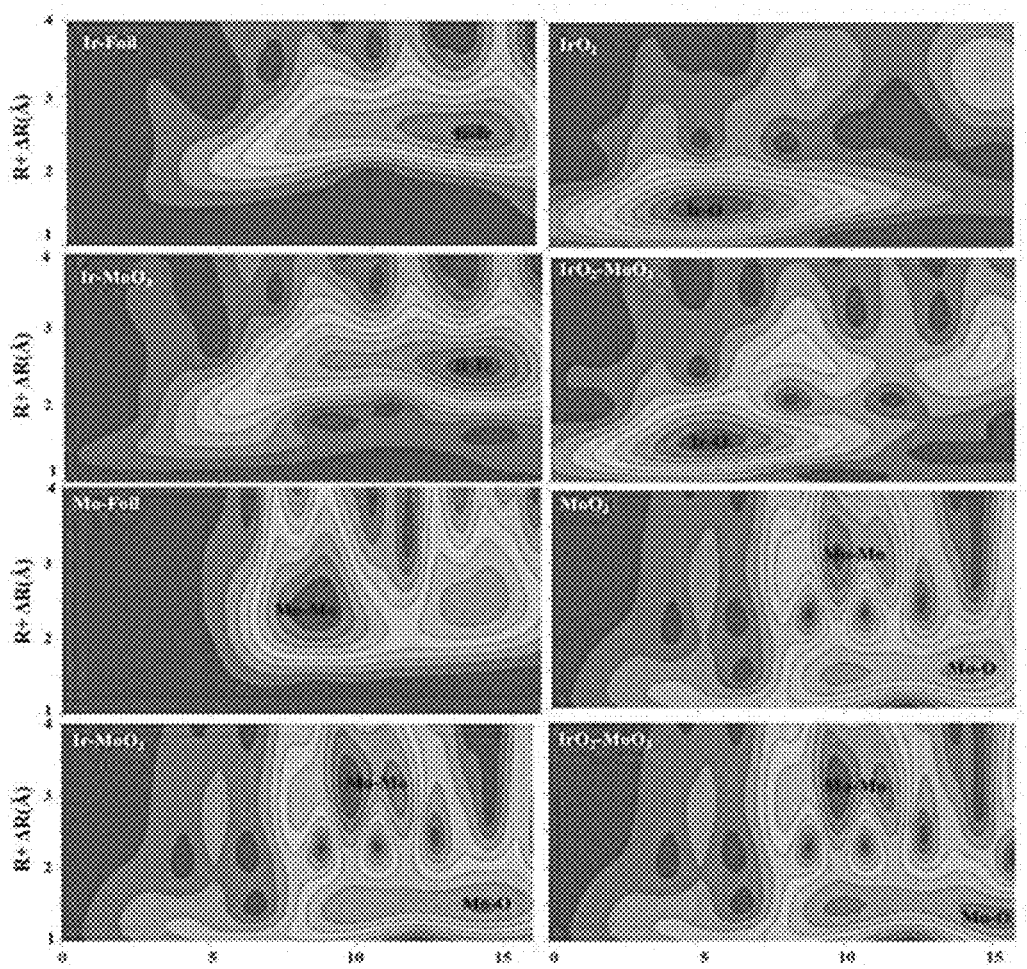

【Fig. 9(A)】
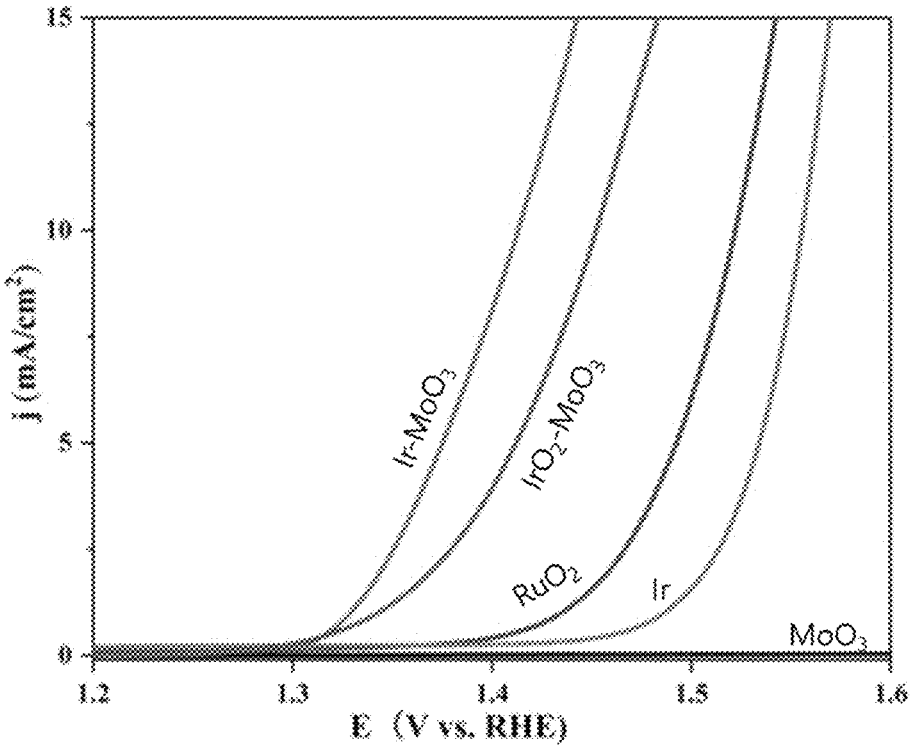

【Fig. 9(B)】
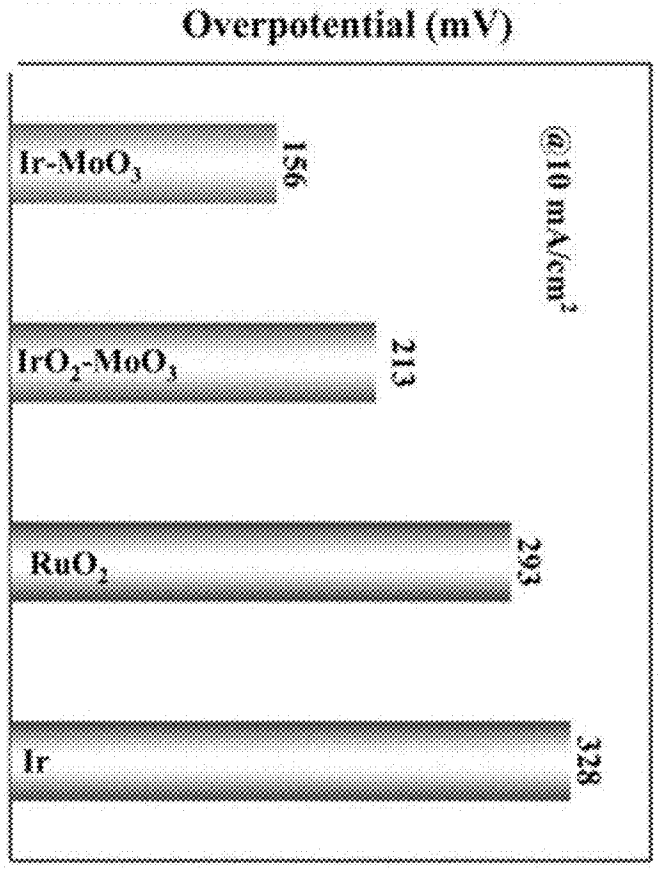

【Fig. 9(C)】
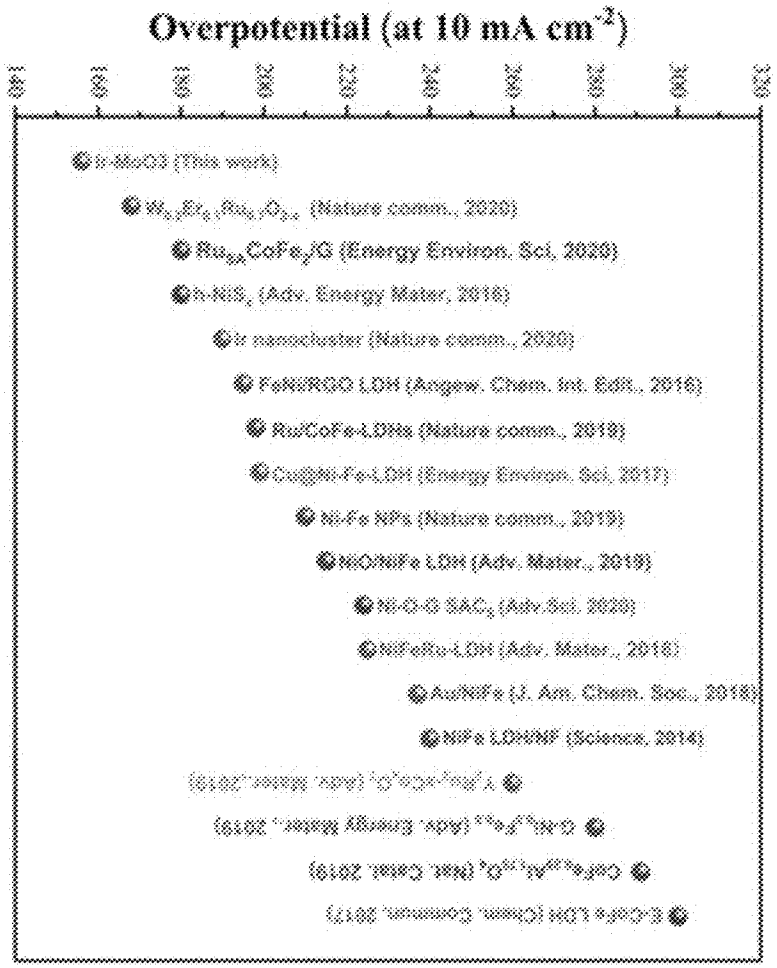

【Fig. 9(D)】
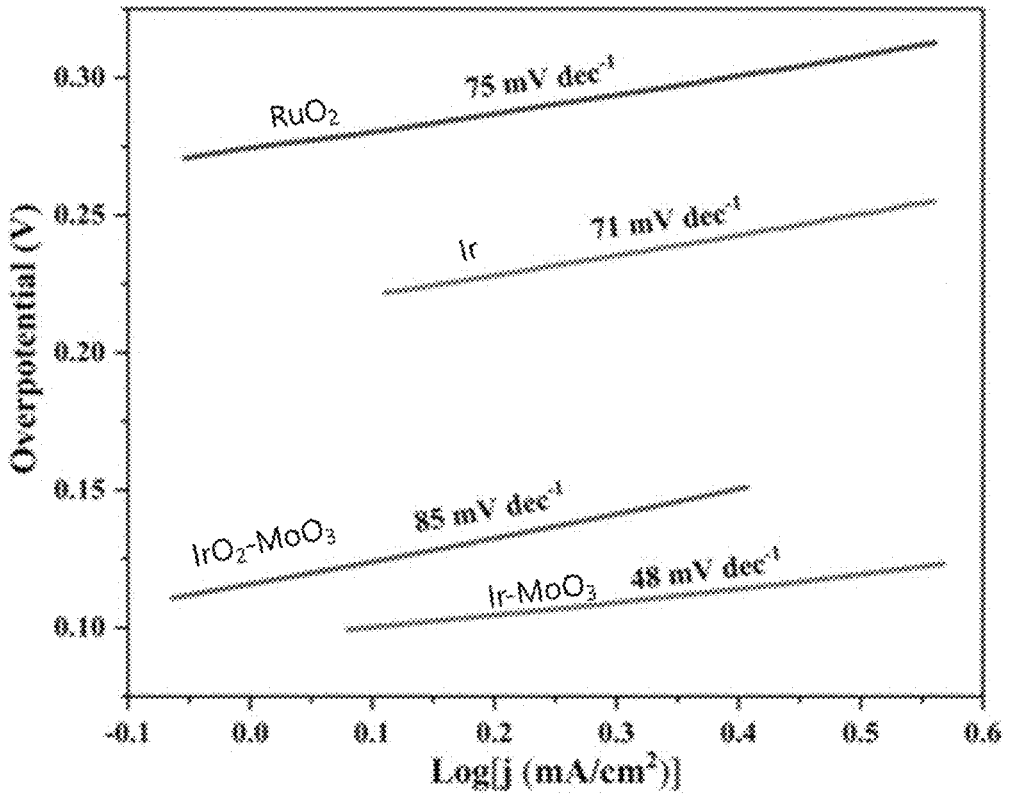

【Fig. 9(E)】
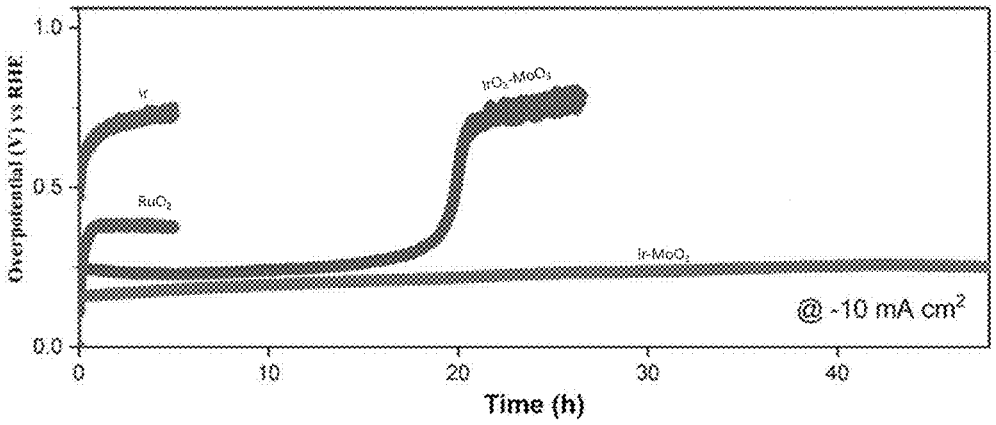

【Fig. 10(A)】
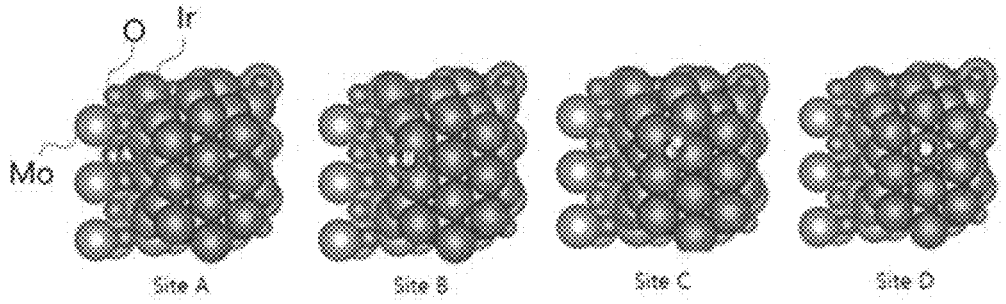
【Fig. 10(B)】
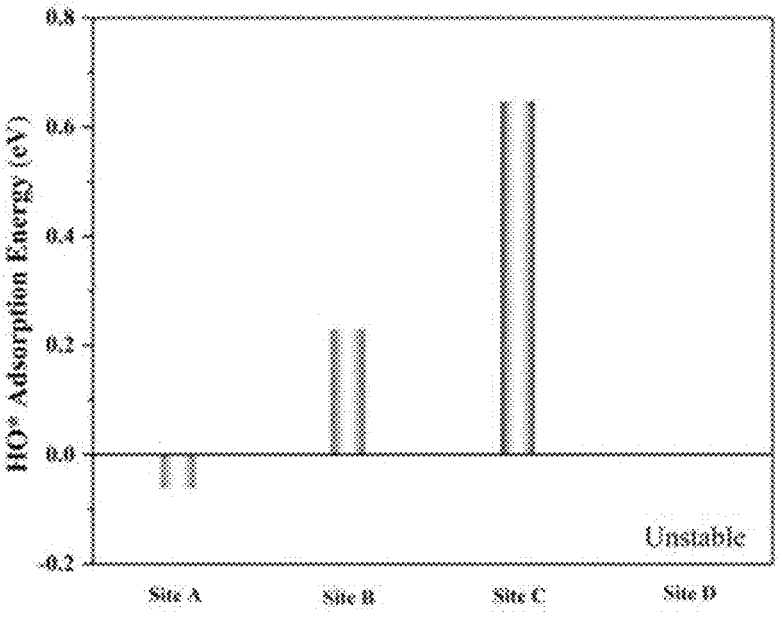

【Fig. 11(A)】
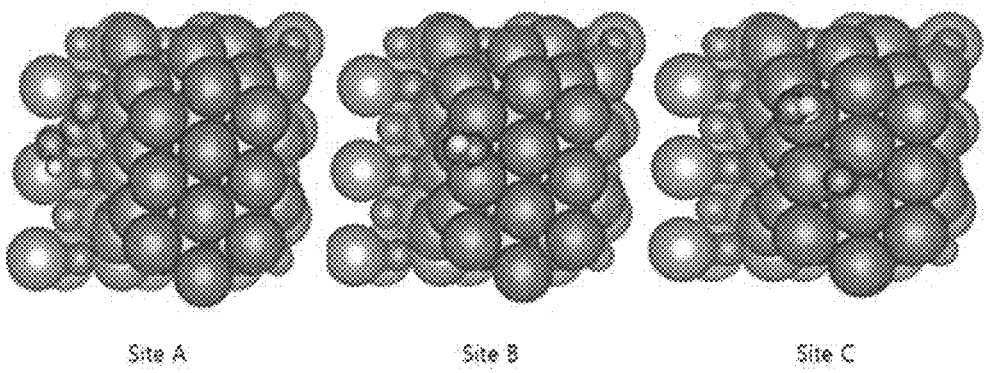
【Fig. 11(B)】
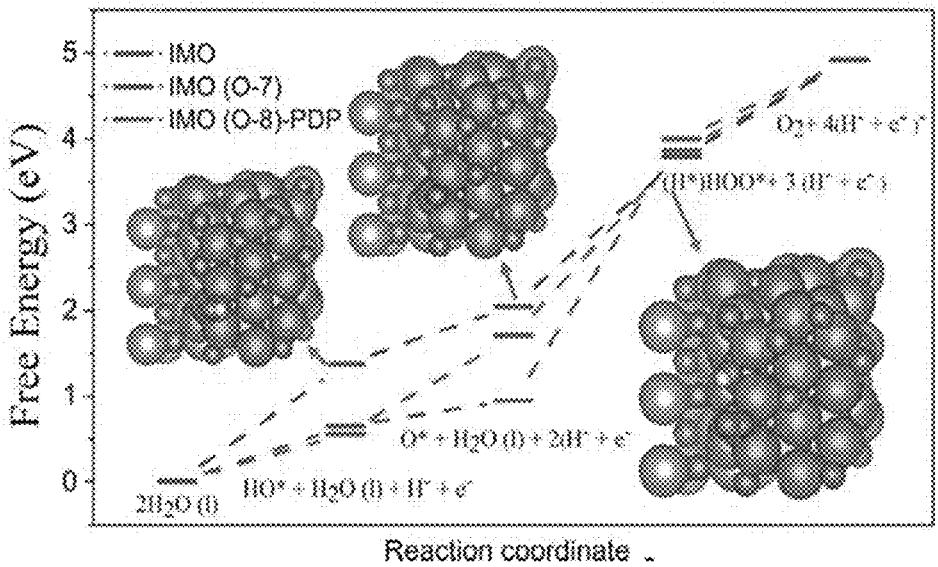

CATALYST FOR ELECTROLYSIS AND PREPARING METHOD OF THE SAME

BACKGROUND OF THE INVENTION

1. Field of the Invention

The present disclosure relates to a catalyst for electrolysis and a preparing method of the same.

2. Description of the Prior Art

Recently, as the use of fossil fuels has been rapidly increasing, the emission of environmental pollutants such as CO2, CO, SOx, and NOx, which are global warming gases, is accelerating. Various alternative energy sources such as solar, wind, and tidal energy have been proposed to reduce dependence on fossil fuels. However, since these alternative energy sources are highly dependent on external conditions such as weather in the process of obtaining energy, and the generated energy cannot be stored as they are, it is difficult to supply power to the power grid stably.

Whereas, since hydrogen energy can be easily obtained by electrolyzing water regardless of external conditions, and the energy can be stored in the form of hydrogen, it is attracting great attention as an energy source capable of replacing fossil fuels. In addition, hydrogen energy is eco-friendly because water is produced in the combustion process, and energy density is about 142 kJ/g, far superior to petroleum (46 kJ/g) or natural gas (47.2 kJ/g).

In addition, the water electrolysis reaction for generating hydrogen energy includes a hydrogen evolution reaction (HER) and an oxygen evolution reaction (OER). The oxygen evolution reaction requires a high overpotential due to a slower reaction rate and a more complex process than the hydrogen evolution reaction.

In addition, water electrolysis in acidic electrolytes more efficiently produces hydrogen compared to alkaline media. However, recent OER catalysts are generally decomposed rapidly under acidic conditions, unstable in highly oxidizing environments, and high costs are required. Accordingly, it is crucial to develop low-cost and high-efficiency OER catalysts, especially the catalysts stable in acidic media.

Korean Patent Registration No. 10-2196904 relates to a preparing method for an oxygen evolution reaction catalyst comprising Ir—Fe oxides using ultrasonic spray pyrolysis and the oxygen evolution reaction catalyst using the same. The above patent discloses an oxygen evolution reaction catalyst including at least one metal oxide selected from iridium and iron that improves catalytic activity and secures stability in an acidic medium; and carbon-based support for supporting the metal oxide; however, it does not mention a catalyst including electron-deficient metal.

SUMMARY OF THE INVENTION

In order to solve the above-mentioned problems in the related art, the present disclosure provides an electrolysis catalyst including an electron-deficient first metal and second metal oxides dispersed in a graphite carbon layer.

In addition, the present disclosure provides a method for preparing the electrolysis catalyst.

In addition, the present disclosure provides an oxygen evolution reaction electrode, including the electrolysis catalyst.

However, the technical problem to be achieved by the embodiments of the present disclosure is not limited to the technical issues described above, and other technical problems may exist.

As a technical solution for achieving the above-described technical problems, the first aspect of the present disclosure provides an electrolysis catalyst including a graphitic carbon layer; and a first metal and a second metal oxide dispersed in the graphitic carbon layer, wherein includes the first metal is electron-deficient.

According to one embodiment of the present disclosure, surface oxygen may exist on the graphitic carbon layer; however, the present disclosure is not limited thereto.

According to one embodiment of the present disclosure, the electron deficiency of the first metal may be increased by the surface oxygen and the second metal oxide; however, the present disclosure is not limited thereto.

According to one embodiment of the present disclosure, the electrolysis catalyst may have a fibrous shape; however, the present disclosure is not limited thereto.

According to one embodiment of the present disclosure, the graphitic carbon layer may be formed by heat-treating a material from the group consisting of polyvinylpyrrolidone, ethanol, N,N-dimethylformamide, dimethyl sulfoxide, polyvinyl alcohol, and a combination thereof; however, the present disclosure is not limited thereto.

According to one embodiment of the present disclosure, The first metal may include one selected from the group consisting of Ir, Rh, Au, Ru, Cu, Ru, Rh, Pd, Ag, Re, Os, Ir, Pt, Au, Hg and a combination thereof; however, the present disclosure is not limited thereto.

According to one embodiment of the present disclosure, the second metal oxide may include one selected from the group consisting of Mo, W, Cr, Mn, Ta, and a combination thereof; however, the present disclosure is not limited thereto.

In addition, a second aspect of the present disclosure provides a method for preparing an electrolysis catalyst, which includes preparing a structure by electrospinning a mixed solution containing a polymer compound, a first metal oxide, and a second metal salt; and heat-treating the system.

According to one embodiment of the present disclosure, the first metal oxide may be deficient in electrons while being reduced to a first metal by the heat treatment; however, the present disclosure is not limited thereto.

According to one embodiment of the present disclosure, the second metal salt may be converted into a second metal oxide by the heat treatment; however, the present disclosure is not limited thereto.

According to one embodiment of the present disclosure, the structure may have a fibrous shape; however, the present disclosure is not limited thereto.

According to one embodiment of the present disclosure, the polymer compound may include one selected from the group consisting of polyvinylpyrrolidone, ethanol, N,N-dimethylformamide, dimethyl sulfoxide, polyvinyl alcohol, and a combination thereof; however, the present disclosure is not limited thereto.

According to one embodiment of the present disclosure, the first metal may include one selected from the group consisting of Ir, Rh, Au, Ru, Cu, Ru, Rh, Pd, Ag, Re, Os, Ir, Pt, Au, Hg and a combination thereof; however, the present disclosure is not limited thereto.

According to one embodiment of the present disclosure, the second metal salt may include one selected from the group consisting of Mo, W, Cr, Mn, Ta, and a combination thereof; however, the present disclosure is not limited thereto.

In addition, a third aspect of the present disclosure provides an oxygen evolution reaction electrode, including the electrolysis catalyst, according to the first aspect of the present disclosure.

The above-described technical solutions are merely exemplary and will not be construed as intended to limit the present disclosure. In addition to the exemplary embodiments described above, additional embodiments may exist in the drawings and the detailed description.

Since the conventional electrolysis catalysts are rapidly decomposed by an acidic environment when electrolysis is performed using an acidic medium, there is a problem with stability, and high costs are required.

However, the electrolysis catalyst, according to the present disclosure, includes a graphitic carbon layer, and a first metal and a second metal oxide dispersed in the graphitic carbon layer, electron deficiency of the first metal may be increased due to the surface oxygen and the second metal oxide present on the graphitic carbon layer. Accordingly, the first metal has a synergistic effect of a high surface state. It can withstand resistance in an acidic medium so that it can implement low potential, high stability, and excellent catalytic performance.

In addition, the electrolysis catalyst, according to the present disclosure, includes the graphitic carbon layer. Accordingly, the graphitic carbon layer serves as a protective layer, imparting high durability and conductivity to the electrolysis catalyst so that rapid electron transfer can be promoted in the process of oxygen evolution reaction.

In addition, according to the present disclosure, the method for preparing an electrolysis catalyst can be performed through a simple scheme of designing a structure using electrospinning and then heat-treating the system.

However, the advantageous effects obtainable herein are not limited to those described above, and other advantageous effects may exist.

BRIEF DESCRIPTION OF THE DRAWINGS

The above and other objects, features, and advantages of the present invention will be more apparent from the following detailed description taken in conjunction with the accompanying drawings in which:

FIG. 1 is a flow chart of an electrolysis catalyst preparing method according to one embodiment of the present disclosure.

FIGS. 2(A) and 2(B) shows a schematic view of the preparation method of the electrolysis catalyst according to one embodiment of the present disclosure and an SEM image of the electrolysis catalyst according to the example.

FIG. 3(A) shows a PXRD pattern of the electrolysis catalyst according to one embodiment of the present disclosure and FIG. 3(B) shows a TEM image.

FIG. 4(A) shows TEM images with line EDS by different contrasts of the electrolysis catalyst according to one embodiment of the present disclosure, and FIG. 4(B) shows TEM-EDS elemental mapping images.

FIG. 5(A) shows HRTEM images of the electrolysis catalyst according to one embodiment of the present disclosure, and FIG. 5(B) shows an ABF-STEM image.

FIG. 6(A) is an HR-XPS of Ir 4f of an electrolysis catalyst according to one experimental example of the present disclosure, FIG. 6(B) is an HR-XPS of Mo 3d, FIG. 6(C) is a schematic view of a charge density difference, and FIG. 6(D) is a schematic view of the charge density difference enlarged in FIG. 6(C).

FIG. 7(A) is a XANES survey spectrum at an Ir L3-edge for the catalyst according to one experimental example of the present disclosure, FIG. 7(B) is a derivative of the L3-edge XANES spectrum, FIG. 7(C) is an Ir L3-edge X-ray absorption Fourier transform (FT) k3 weighted EXAFS spectrum in an R space, FIG. 7(D) is a XANES irradiation spectrum in a Mo K-edge XANES spectrum, FIG. 7(E) is a peak derived function of the L3-edge XANES spectrum, and FIG. 7(F) is a Mo K-edge X-ray absorption Fourier transform (FT) k3 weighted EXAFS spectrum in an R space.

FIG. 8 shows wavelet transforms (WT-EXAFS) for catalysts according to one experimental example of the present disclosure.

FIG. 9(A) shows OER polarization curves of electrolysis catalysts of one experimental example of the present disclosure, FIG. 9(B) shows a comparison of overpotentials required to reach a current density of 10 mA $cm^{-2}$, FIG. 9(C) compares the OER activity of several catalysts, FIG. 9(D) shows Tafel plots of prepared electrodes and FIG. 9(E) shows time versus potential difference curves.

FIG. 10(A) shows schematic diagrams illustrating various sites of one embodiment of the present disclosure to identify the optimal site for HO* adsorption, and FIG. 10(B) shows a graph showing the adsorption energy of each site.

FIG. 11(A) shows schematic views illustrating the configuration of HOO* for sites A, B, and C after relaxation according to one experimental example of the present disclosure, and FIG. 11(B) shows schematic diagrams of relative energy profiles and simplified surface structures of various reactive species as defined by arrows.

DETAILED DESCRIPTION OF THE EXEMPLARY EMBODIMENTS

Hereinafter, the embodiments of the present disclosure will be described in detail with reference to the accompanying drawings so that the embodiments may be easily carried out by those having ordinary skills in the art.

However, the present disclosure may be implemented in various forms and is not limited to the Examples described herein. In addition, parts irrelevant to the description are omitted in the drawings to clearly explain the present disclosure, and reference numerals designate like parts throughout the specification.

Throughout the specification herein, when a part is "connected" to another part, the above expression includes not only "direct connection" but also includes "electrical connection" with another element interposed therebetween.

Throughout the specification herein, when one element is located "on", "above", "at the uppermost part of", "under", "below", or "at the lowermost part of" other element, this includes not only a case where the one member is in contact with the other member but also a case where another member is present between the two members.

Throughout the specification herein, when a part "includes" a certain component, the above expression does not exclude other elements, but may further include the other elements unless particularly stated otherwise.

The terms for describing the degree, such as "about" and "substantially", as used herein may be used to signify a numerical value or a numerical value close to the numerical value when manufacturing and material tolerances inherent in the stated meanings are given, and may be used to prevent undue exploitation by unscrupulous infringers on the disclosed disclosure in which exact or absolute numerical values are stated to facilitate the understanding of the present disclosure. In addition, throughout the specification herein, "a step of ~" or "a step in which ~" does not signify "a step for ~".

Throughout the specification herein, the term "a combination thereof" included in the expression of the Markush form signifies a mixture or combination of at least one selected from the group consisting of the components listed in the presentation of the Markush form. It signifies including at least one selected from the group consisting of the above components.

Throughout the specification herein, the description of "A and/or B" signifies "either A or B, or A and B".

Hereinafter, the electrolysis catalyst, a preparation method of the same, and an oxygen evolution reaction electrode, including the same, which will be described in detail regarding embodiments, examples, and drawings. However, the present disclosure is not limited to the models, examples, or illustrations.

As a technical solution for achieving the above-described technical problems, the first aspect of the present disclosure provides an electrolysis catalyst including a graphitic carbon layer; a first metal and a second metal oxide dispersed in the graphitic carbon layer, wherein the first metal is electron-deficient.

Since the conventional electrolysis catalysts are rapidly decomposed by an acidic environment when electrolysis is performed using an acidic medium, there is a problem with stability, and high costs are required.

However, the electrolysis catalyst, according to the present disclosure, includes a graphitite carbon layer, and a first metal and a second metal oxide dispersed in the graphitite carbon layer, electron deficiency of the first metal may be increased due to the surface oxygen and the second metal oxide present on the graphitite carbon layer. Accordingly, the first metal has a synergistic effect of a high surface state. It can withstand resistance in an acidic medium, so low potential, high stability, and excellent catalytic performance can be implemented.

In addition, the electrolysis catalyst, according to the present disclosure, includes the graphitic carbon layer, and accordingly, the graphitic carbon layer serves as a protective layer, thereby imparting high durability and conductivity to the electrolysis catalyst, so that rapid electron transfer can be promoted in the process of oxygen evolution reaction.

According to one embodiment of the present disclosure, surface oxygen may exist on the graphitic carbon layer; however, the present disclosure is not limited thereto. According to one embodiment, surface oxygen may be derived from oxygen in the atmosphere during a heat-treatment process described below.

Surface oxygen refers to an oxygen atom attached to a metal surface.

According to one embodiment of the present disclosure, the electron deficiency of the first metal may be increased by the surface oxygen and the second metal oxide; however, the present disclosure is not limited thereto.

A single metal atom is composed of one metal atom, for example, a platinum atom. Metal particles in which single metal atoms are gathered are included, such as gold nanoparticles.

Oxidation number refers to the number of charges that a particular atom constituting a material has when it is assumed that the exchange of electrons has occurred entirely within the material. For a single atomic material, the oxidation number is 0.

Since the first metal of the electrolysis catalyst, according to the present disclosure, is a single atomic material that does not exist as a compound, the oxidation number is required to be 0. However, the surface oxygen and the second metal oxide present in the vicinity attract electrons of the first metal, and accordingly, the first metal becomes deficient in electrons, and the oxidation number may be increased. The first metal may have an oxidation number higher than the oxidation number during existing in an ionic state. In other words, the first metal may be deficient in more electrons than when it exists in an ionic state.

For example, Ir exists with a deficit of 3 or 4 electrons when being in an ionic state. In other words, Ir ion is a material having an oxidation number of +3 or +4. When the first metal is Ir, the oxidation number of Ir, which is a single atomic material, is required to be 0. However, electrons of the Ir are pulled due to the surface oxygen and the second metal oxide present in the vicinity, and accordingly, electrons of Ir may be deficient, and the oxidation number may be increased. More electrons may be deficient than when the Ir exists in the ionic state. In other words, 4 or more electrons may be deficient; however, the present disclosure is not limited thereto.

According to one embodiment of the present disclosure, the electrolysis catalyst may have a fibrous shape; however, the present disclosure is not limited thereto.

The electrolysis catalyst of the present disclosure may be prepared by electrospinning to have a fibrous shape, however, the present disclosure is not limited thereto.

According to one embodiment of the present disclosure, the graphitic carbon layer may be formed by heat-treating a material from the group consisting of polyvinylpyrrolidone, ethanol, N,N-dimethylformamide, dimethyl sulfoxide, polyvinyl alcohol, and a combination thereof; however, the present disclosure is not limited thereto.

Graphite refers to hard, coal-like graphite rock between Precambrian schists, and the graphitic carbon layer may be formed by heat-treating an organic polymer material containing carbon atoms. However, the present disclosure is not limited thereto.

According to one embodiment of the present disclosure, the first metal may include one selected from the group consisting of Ir, Rh, Au, Ru, Cu, Ru, Rh, Pd, Ag, Re, Os, Ir, Pt, Au, Hg and a combination thereof; however, the present disclosure is not limited thereto.

According to one embodiment of the present disclosure, the second metal oxide may include one selected from the group consisting of Mo, W, Cr, Mn, Ta, and a combination thereof; however, the present disclosure is not limited thereto.

In addition, a second aspect of the present disclosure provides a method for preparing an electrolysis catalyst, which includes: preparing a structure by electrospinning a mixed solution containing a polymer compound, a first metal oxide, and a second metal salt; and heat-treating the structure.

For the electrolysis catalyst of the second aspect of the present disclosure, detailed descriptions of parts overlapping with the first aspect of the present disclosure have been omitted. Even when the description is omitted, the contents described in the first aspect of the present disclosure may be equivalently applied to the second aspect of the present disclosure.

According to the present disclosure, the method for preparing an electrolysis catalyst can be performed through a simple scheme of preparing a structure using electrospinning and then heat-treating the structure.

FIG. 1 is a flow chart of an electrolysis catalyst preparing method according to one embodiment of the present disclosure.

First, a structure is prepared by electrospinning a mixed solution containing a polymer compound, a first metal oxide, and a second metal salt (S100).

FIGS. 2(A) and 2(B) shows a schematic view of the preparing method of the electrolysis catalyst according to one embodiment of the present disclosure and an SEM image of the electrolysis catalyst according to the example. Specifically, FIG. 2(A) shows a schematic view of step (S100) of preparing a structure by electrospinning a mixed solution containing a polymer compound, a first metal oxide, and a second metal salt, and an SEM image of a structure formed on a current collector. FIG. 2(B) shows schematic views of step (S200) of heat-treating the structure and SEM images of the structure before and after heat treatment.

In this regard, in FIGS. 2(A) and 2(B), $IrO_2$ is used as the first metal oxide, Mo salt is used as the second metal salt, and polyvinylpyrrolidone is used as the polymer compound. However, the present disclosure is not limited thereto.

According to one embodiment of the present disclosure, the structure may have a fibrous shape; however, the present disclosure is not limited thereto.

Referring to FIG. 2(A), an electrospinning synthesis scheme designed to prepare the electrolysis catalyst of the present disclosure can be confirmed. After a mixed solution containing a polymer compound, a first metal oxide, and a second metal salt is injected into a syringe, the mixed solution is sprayed by applying a voltage onto a rotating current collector, thereby preparing a structure. As a result, it can be confirmed that a structure having a fibrous shape is prepared.

Then, the structure is subjected to heat treatment (S200).

According to one embodiment of the present disclosure, the first metal oxide may be deficient in electrons while being reduced to a first metal by the heat treatment, however, the present disclosure is not limited thereto.

According to one embodiment of the present disclosure, the second metal salt may be converted into a second metal oxide by the heat treatment; however, the present disclosure is not limited thereto.

Referring to FIG. 2(B), it can be confirmed that the structure composed of the first metal oxide, the second metal salt, and the polymer compound is converted, through heat treatment, into a structure including the graphitic carbon layer, the first metal, and the second metal oxide. Specifically, through the heat treatment, $IrO_2$ as the first metal oxide is reduced to Ir, Mo salt as the second metal salt is converted to MoO3, and polyvinylpyrrolidone as the polymer compound is formed as a graphitic carbon layer, thereby obtaining the electrolysis catalyst according to the present disclosure. The $IrO_2$ may be reduced to Ir, and electrons may be deficient; however, the present disclosure is not limited thereto.

According to one embodiment of the present disclosure, the polymer compound may include one selected from the group consisting of polyvinylpyrrolidone, ethanol, N,N-dimethylformamide, dimethyl sulfoxide, polyvinyl alcohol, and a combination thereof; however, the present disclosure is not limited thereto.

According to one embodiment of the present disclosure, the first metal may include one selected from the group consisting of Ir, Rh, Au, Ru, Cu, Ru, Rh, Pd, Ag, Re, Os, Ir, Pt, Au, Hg and a combination thereof; however, the present disclosure is not limited thereto.

According to one embodiment of the present disclosure, the second metal salt may include one selected from the group consisting of Mo, W, Cr, Mn, Ta, and a combination thereof; however, the present disclosure is not limited thereto.

According to one embodiment, the electrolysis catalyst may have an electrospun fibrous shape and extends in one direction, as described above. In addition, the electrolysis catalyst may include the graphitic carbon layer as a matrix, and particles of the first metal and particles of the second metal oxide may be dispersed in the matrix of the graphitic carbon layer. In this case, the first metal particles may be arbitrarily dispersed in the matrix of the graphitic carbon layer while being attached to the particles of the second metal oxide.

In addition, according to one embodiment, the ratio of the electron-deficient first metal in the electrolysis catalyst may be controlled in heat-treating the structure. In other words, the particle ratio of the electron-deficient first metal may be controlled among particles of a plurality of first metals provided in the electrolysis catalyst. Specifically for example, when the concentration of oxygen is increased during the heat treatment of the structure, the particle ratio of the electron-deficient first metal (for example, Ir4+) in the electrolysis catalyst may be increased. Alternatively, unlike the above description, for example, when the heat-treatment time is increased during the heat-treatment of the structure, the reaction between the surface oxygen and the first metal may be increased so that the particle ratio of the electron-deficient first metal (for example, Ir4+) in the electrolysis catalyst may be increased.

In addition, according to one embodiment, the process conditions for electrospinning may be controlled in preparing the structure so that the ratio of the electron-deficient first metal in the electrolysis catalyst may be controlled. Specifically, during the electrospinning process, and when a diameter for spinning the mixed solution containing the polymer compound, the first metal oxide and the second metal salt is decreased, a relatively large number of the first metal oxides may be exposed to oxygen. Accordingly, the particle ratio of the electron-deficient first metal (Ir4+) in the electrolysis catalyst may increase.

In addition, according to one embodiment, the ratio between the first metal oxide and the second metal salt in the mixed solution may be controlled in preparing the mixed solution. Specifically, in the mixed solution, the ratio of the first metal may be 0.01 to 99, and the ratio of the second metal maybe 1 to 99.99. Accordingly, the OER characteristics of the electrolysis catalyst prepared from the mixed solution may be improved.

In addition, a third aspect of the present disclosure provides an oxygen evolution reaction electrode, including the electrolysis catalyst, according to the first aspect of the present disclosure.

For the oxygen evolution reaction electrode of the third aspect of the present disclosure, detailed descriptions of parts overlapping with the first and/or the second aspects of the present disclosure have been omitted. Even when the description is omitted, the contents described in the first and/or the second aspects of the present disclosure may be equivalently applied to the third aspect of the present disclosure.

The electrolysis catalyst, according to the present disclosure, includes the electron-deficient metal, thereby withstanding resistance in acidic media, and accordingly, used as an electrode for oxygen evolution reaction in the acidic medium so that high stability and excellent catalytic performance can be implemented. However, the present disclosure is not limited thereto.

The above-described technical solutions are merely exemplary and will not be construed as intended to limit the present disclosure. In addition to the exemplary embodiments described above, additional embodiments may exist in the drawings and the detailed description.

Hereinafter, the present disclosure will be described in further detail concerning Examples. However, the following Examples are for illustrative purposes only and are not intended to limit the scope of the present disclosure.

[Example] Preparation of Ir—MoO3

First, 1 mmol of IrO2, 1 mmol of ammonium molybdate (para) tetrahydrate, and 1.2 g of PVP were added to a mixed solvent of dimethylformamide (5 mL DMF) and alcohol (5 mL EtOH) and stirred at 80° C. for 12 hours.

Then, the mixed solution was added to a 10 mL plastic syringe with a 25 gauge stainless steel needle. An applied a direct current voltage, and a distance between the needle and a current collector wrapped in aluminum foil were fixed at 15 kV and 12 cm, respectively. The flow rate of the mixed solution was maintained at 10 μL/min.

Then, the prepared material was annealed at 500° C. for 3 hours in air at a heating rate of 5° C./min, thereby preparing Ir—MoO3.

Ru—MoO3, Rh—MoO3, and Au—MoO3 may be prepared in the same method by selecting an appropriate metal oxide instead of IrO2.

[Comparative Example] Preparation of IrO2-MoO3

First, 1 mmol of ammonium molybdate (para) tetrahydrate and 1.2 g of PVP was added to a mixed solvent of dimethylformamide (5 mL DMF) and alcohol (5 mL EtOH) and stirred at 80° C. for 12 hours.

Then, the mixed solution was added to a 10 mL plastic syringe with a 25 gauge stainless steel needle. An applied direct current voltage and a distance between the needle and a current collector wrapped in aluminum foil were fixed at 15 kV and 12 cm, respectively. The flow rate of the mixed solution was maintained at 10 μL/min.

Then, the prepared material was mixed with $IrO_2$ (1 mmol) and annealed at 500° C. for 3 hours in air at a heating rate of 5° C./min, thereby preparing IrO2-MoO3.

[Experimental Example 1] Characteristic Analysis of Electrolysis Catalyst

FIG. 3(A) is a PXRD pattern of the electrolysis catalyst according to one embodiment of the present disclosure and FIG. 3(B) is a TEM image.

FIG. 4(A) shows TEM images with line EDS by different contrasts of the electrolysis catalyst according to one embodiment of the present disclosure and FIG. 4(B) shows TEM-EDS elemental mapping images.

FIG. 5(A) shows HRTEM images of the electrolysis catalyst according to one embodiment of the present disclosure and FIG. 5(B) shows an ABF-STEM image.

Referring to FIG. 3(A), X-ray diffraction (XRD) patterns indicated that iridium has a metallic characteristic. In addition, referring to FIG. 3(B), as a result of observing the shape and distribution characteristics of the example using TEM, it can be seen that the nanorods are connected to each other to form a 3D network structure with assists of the graphitic carbon layer. The schematic morphology and elemental distribution of Ir, Mo, O, and C indicate that the heterostructure of IMO has been successfully prepared.

Referring to FIG. 4(A), different contrast TEM images show Mo and Ir distributions according to atomic number dependence of Z contrast. In addition, referring to FIG. 4(B), EDS mapping images demonstrate that the elements of Mo, Ir and O are uniformly distributed.

Referring to FIG. 5(A), high-resolution TEM (HRTEM) images are used to identify the lattice edges of the example. Crystal lattice distances of 0.35 nm and 0.22 nm correspond to a plane (040) of MoO3 and a plane (111) of Ir, respectively. The section (040) of MoO3 and the section (111) of Ir may be obtained at 37.8° and 40.7° from XRD patterns identical to the HRTEM images. In addition, the low peak intensity of 40.7° indicates that Ir having a crystal size is preferably dispersed in MoO3, thereby facilitating the interaction between Ir and MoO3. It is noted that the graphitic carbon layer may be observed at the edge of the example, evidenced by the control HRTEM image. The graphitic carbon layer is not an active site for catalysis reaction and has a concept only to serve to increase electron transfer and improve catalyst stability.

Referring to FIG. 5(B), atomic resolution ABF-STEM images can be seen. An Ir metal area in the red box of FIG. 5(A) was collected.

Experimental Example 2

FIG. 6(A) is an HR-XPS of Ir 4f of an electrolysis catalyst according to one experimental example of the present disclosure, FIG. 6(B) is an HR-XPS of Mo 3d, FIG. 6(C) is a schematic view of a charge density difference and FIG. 6(D) is a schematic view of the charge density difference enlarged in FIG. 6(C). Specifically, yellow and cyan areas represent electron accumulation and depletion, respectively, and red, gold, and purple colors represent O, Ir, and Mo atoms. An equivalent surface value is 0.015 e/bohr3.

Referring to FIG. 6(A), Ir 4f of the example is remarkably high in an energy shift amount compared to the Comparative Example, and this indicates that the Ir nanoparticles (NPs) emitted electrons due to low electronegativity. High-resolution XPS (HR-XPS) of Mo 3d (FIG. 3(B)) was further analyzed in order to analyze the above phenomenon further. Referring to FIG. 6(B), it can be seen that a Mo5+ 3d peak is clearly observed in Mo 3d of the example, but a peak of Mo5+ 3d (about 231.72 eV) rarely appears in the comparative example.

Referring to FIGS. 6(C) and 6(D), charge density differences were calculated to investigate electron transfer through Ir and MoO3 of the Example. The electrons of Ir are transferred to Mo as observed in the charge density difference image.

Experimental Example 3

FIG. 7(A) is a XANES survey spectrum at an Ir L3-edge for the catalyst according to one experimental example of the present disclosure, FIG. 7(B) is a derivative of the L3-edge XANES spectrum, FIG. 7(C) is an Ir L3-edge X-ray absorption Fourier transform (FT) k3 weighted EXAFS spectrum in an R space, FIG. 7(D) is a XANES irradiation spectrum in a Mo K-edge XANES spectrum, FIG. 7(E) is a peak derived function of the L3-edge XANES spectrum, and FIG. 7(F) is a Mo K-edge X-ray absorption Fourier transform (FT) k3 weighted EXAFS spectrum in an R space.

FIG. 8 shows wavelet transforms (WT-EXAFS) for catalysts according to one experimental example of the present disclosure.

Referring to FIGS. 7 and 8, X-ray absorption near-field structure (XANES) and extended X-ray absorption fine structure (EXAFS) analyses were utilized as mass average information to analyze phase structures of Examples and Comparative Examples. An Ir L3-edge of the Example shifts in the positive direction compared to an Ir metal foil, due to the high electron deficient surface of the Example (FIG. 7(A)).

In addition, a peak of an Ir L3-edge derivative XANES of the Example is at an energy position lower than that of the Comparative Example, which signifies that the metallic characteristic of Ir nanoparticles is consistent with the XANES and XRD analysis (FIG. 7(B)).

The Fourier Transform (FT) k2 weighted EXAFS spectrum of the Ir L3 edge shows a prominent peak at 1.65 Å assigned to an Ir—O first coordination shell of $IrO_2$ and a prominent peak at 2.58 Å assigned to an Ir—Ir first coordination shell of Ir NPs. This is consistent with the previous $IrO_2$ and metal Ir (FIG. 7(C)).

In order to cross-validate the electron deficient surface of the example, the electron transfer from the Ir element to the Mo element was confirmed by examining the position change of the Mo K-edge absorption edge identified by XPS (FIG. 7(D)). The Mo K-edge absorption of the example shifts to energy lower than that of the Comparative Example and MoO3 (see the enlarged portion of FIG. 7(D)), and this was consistent with the Mo5+ 3d peak in XPS, but no noticeable phase change of MoO3 was confirmed by XRD.

Accordingly, the peak derivative of XANES for the Mo K-edge in the example shifts to lower energy as indicated by the direction of the red arrow compared to the Comparative Example consistent with the Ir L3-edge analysis and MoO3 (FIG. 7(E)).

The difference between the example, the Comparative Example and MoO3 is rarely observed in the FT k3 weighted EXAFS spectrum of the Mo K-edge (FIG. 7(F)), and the characteristic peak of MoO3 consistent with previous reports is expressed.

Wavelet transformations (WT) for Ir L3-edge and Mo K-edge EXAFS analysis were applied to demonstrate the atomic dispersion of the example and the Comparative Example, respectively (FIG. 8). WT of Ir L3-edge associated with Ir—Ir binding was detected in the Ir foil and in the example, thereby confirming the metallic characteristic of Ir in the example. On the contrary, the Comparative Example has a WT pattern similar to $IrO_2$ consistent with the XRD, XANES, and EXAFS analyses. In addition, the WT patterns for the example and the Comparative Example show signals similar to those of MoO3 different from Mo foils. The metal Ir nanoparticles of the example show a surface oxidation significantly higher than that of $IrO_2$ of the Comparative Example by combining XAFS results (Ir L3-edge and Mo K-edge) with XPS data analysis.

Experimental Example 4

FIG. 9(A) shows an OER polarization curve of the electrolysis catalyst of the Experimental Example of the present disclosure, FIG. 9(B) shows a comparison of overpotentials required to reach a current density of 10 mA $cm^{-2}$, FIG. 9(C) shows a comparison of the OER activity of several catalysts, FIG. 9(D) shows Tafel plots of prepared electrodes, and FIG. 9(E) shows time versus potential difference curves.

Referring to FIG. 9, the OER catalytic activity of the example is significantly high, as evidenced by the overpotential (η) of −156 mV at the same current density (10 mA $cm^{-2}$, see FIGS. 9(A) and 9(B)). Surprisingly, due to the unique electron-deficient surface structure, the example shows the highest OER efficiency with ultra-low overpotential compared to the recently reported literatures (FIG. 9(C)).

A Tafel slope is derived from the polarization curve to provide further insight into the OER mechanism (FIG. 9(D)). The Tafel slope of the example is 48 mV dec-1, which is significantly lower than RuO2. It may be concluded that all measurements of the Tafel slope are less than 120 mV dec-1, and surface species formed in the step just before a rate-determining step do not predominate. Due to the high coverage of the active species at a vacant site which decreases a Tafel slope value, the low Tafel slope of the example may cause the high number of oxygen species on the surface Ir of the Example. In the example, the absorbed oxygen species provide a high valence state surface of Ir and decrease the Tafel slope value, thereby accelerating the OER process and increasing the OER efficiency.

In order to evaluate the durability of the catalyst, chronopotentiometry curves of the Example, Ir and $RuO_2$ were collected for 48 hours. In the example, a significant loss did not occur at a constant anodic current density of 10 mA $cm^{-2}$ in 0.5 M H2SO4. In contrast, Ir and $RuO_2$ were indicated as unstable when the overpotential was rapidly increased within a few hours (FIG. 9(E)).

Experimental Example 5

As demonstrated using in situ and ex-situ x-ray spectroscopy, the catalytic activity was further investigated by DFT while being inspired by the unique structure of the electron-deficient surface that helps the OER efficiency.

FIG. 10(A) shows schematic diagrams illustrating various sites of one embodiment of the present disclosure to identify the optimal site for HO* adsorption and FIG. 10(B) shows a graph showing the adsorption energy of each site. In this regard, sites A, B, C, and D refer to an interface site between MoO3 and Ir, an edge site of Ir, a hollow site of Ir, and a top site of Ir, respectively.

Referring to FIG. 10, as a result of comparing the sites, it was confirmed that sites A, B, and C were more advantageous for HO* adsorption than D sites. The above result is interpreted based on the fact that site D is unstable during an optimization process and prevented from becoming an active site in the OER process, and site D shows a critical distance of 2.72 Å. Accordingly, it was confirmed that site D is not a site preferable for oxygen adsorption compared to sites A, B, and C.

Based on the above results, the activity mechanisms of sites A, B, and C were further investigated.

FIG. 11(A) shows schematic views illustrating the configuration of HOO* for sites A, B, and C after relaxation according to one experimental example of the present disclosure, and FIG. 11(B) shows schematic diagrams of relative energy profiles and simplified surface structures of various reactive species as defined by arrows.

Referring to FIG. 11, it was confirmed that, because the HOO* configuration is truncated to O* and HO* during the optimization process at sites A and C, site B has the OER process more preferable than sites A and C. At site B, the intermediate configuration of HOO* was stable, but the energy barrier was still high.

Various amounts of surface oxygen species were considered in order to obtain insight into the OER mechanism of the example while considering the increasing OER efficiency. As a result, it was confirmed that the Ir metal surface having 8 surface oxygen atoms had the highest formation energy (−1.74 eV/atom) compared to other amounts of surface oxygen atoms (−1.63 eV/atom for 7 surface oxygens, −1.62 eV/atom for 9 surface oxygens, and −1.42 eV/atom for 10 surface oxygens), and the example with 7 surface oxygen atoms (O-7) showed a lower OER energy barrier by decreasing the energy barrier.

In addition, to break the scaling relationship between HOO* and HO*, a proton dissociation pathway (PDP) was proposed for the example with 8 surface oxygen atoms (O-8). As a result, it was confirmed that PDP exhibits the lowest energy barrier when protons move to adjacent surface oxygen compared to other OER pathways.

Through Experimental Example 5, it was confirmed that the surface oxygen participates as a proton acceptor in the OER reaction to powerfully reveal the origin of the excellent catalytic OER performance of the example so that a highly efficient catalyst can be designed.

The above description of the present disclosure is merely for illustration, and it will be apparent that a person having ordinary skill in the art may carry out various deformations and modifications within the scope without departing from the idea of the present disclosure, the following claims, and equivalents thereof. Therefore, the above-described embodiments will be understood in all respects as illustrative and not restrictive. For example, each component described as unitary may be implemented in a distributed manner. Likewise, components that are described as distributed may also be implemented in a combined form.

The scope of the present disclosure is indicated by the following claims rather than the above-detailed description, and all deformations or modifications derived from the idea and scope of the claims and their equivalents should be construed as being included in the scope of the present disclosure.

What is claimed is:

1. An electrolysis catalyst comprising:

a graphitic carbon layer; and a first metal and a second metal oxide dispersed in the graphitic carbon layer, wherein the first metal is electron-deficient, the first metal consists of Ir, and the second metal oxide includes Mo, wherein a number of surface oxygen atoms of the Ir is 8.

2. The electrolysis catalyst of claim 1, wherein the first metal has an electron deficiency increased by the surface oxygen atoms and the second metal oxide.

3. The electrolysis catalyst of claim 1, wherein the electrolysis catalyst has a fibrous shape.

4. The electrolysis catalyst of claim 1, wherein the graphitic carbon layer is formed by heat-treating a material from the group consisting of polyvinylpyrrolidone, ethanol, N,N-dimethylformamide, dimethyl sulfoxide, polyvinyl alcohol, and a combination thereof.

5. A method for preparing an electrolysis catalyst, the method comprising:

preparing a structure by electrospinning a mixed solution containing a polymer compound, a first metal oxide, a second metal salt; and heat-treating the structure, wherein the first metal oxide consists of iridium oxide, the second metal salt includes Mo, and the heat-treating is performed such that a number of surface oxygen atoms of Ir in the electrolysis catalyst is 8.

6. The method of claim 5, wherein the first metal oxide is deficient in electrons while being reduced to a first metal by heat-treating.

7. The method of claim 5, wherein the heat-treating converts the second metal salt into a second metal oxide.

8. The method of claim 5, wherein the structure has a fibrous shape.

9. The method of claim 5, wherein the polymer compound includes one selected from the group consisting of polyvinylpyrrolidone, ethanol, N, N-dimethyl formamide, dimethyl sulfoxide, polyvinyl alcohol, and a combination thereof.

10. An oxygen evolution reaction electrode comprising:

an electrolysis catalyst according to claim 1.

11. The electrolysis catalyst of claim 1, wherein the Ir having 8 surface oxygen atoms has a higher formation energy than Ir having 7, 9, or 10 surface oxygen atoms.

* * * * *